US006021544A

United States Patent [19]

Eberwein

[11] Patent Number: 6,021,544

[45] Date of Patent: Feb. 8, 2000

[54] STRIP BLASTING APPARATUS

[75] Inventor: Klaus-Peter Eberwein, Erkrath, Germany

[73] Assignee: SMS Schloemann-Siemag Aktiengesellschaft, Düsseldorf, Germany

[21] Appl. No.: 09/065,316

[22] Filed: Apr. 23, 1998

[30] Foreign Application Priority Data

Apr. 25, 1997 [DE] Germany ..... 19 17 456

[51] Int. Cl.[7] ..... A47L 5/38

[52] U.S. Cl. ..... 15/316.1; 15/309.1

[58] Field of Search ..... 15/309.1, 316.1; 29/81.09; 34/636, 639, 643; 451/80, 83, 89; 134/153, 199

[56] References Cited

U.S. PATENT DOCUMENTS

| | | | |
|---|---|---|---|
| 955,469 | 4/1910 | Motz | 451/89 |
| 3,902,513 | 9/1975 | Franz | 134/199 |
| 4,400,961 | 8/1983 | Schaming | 72/201 |
| 4,601,112 | 7/1986 | Kush et al. | 34/331 |
| 4,691,549 | 9/1987 | Adair | 72/38 |
| 5,398,372 | 3/1995 | Kush | 15/316.1 |
| 5,440,779 | 8/1995 | Collinson | 15/316.1 |

*Primary Examiner*—Terrence R. Till
*Assistant Examiner*—Theresa T. Snider
*Attorney, Agent, or Firm*—Friedrich Kueffner

[57] ABSTRACT

An apparatus for blasting a strip emerging from a roll stand, wherein the apparatus includes a separate strip edge blasting unit, wherein the strip edge blasting unit and the strip blasting apparatus are control-technically connected to each other. The strip edge blasting unit includes nozzle beams with several nozzles whose nozzle beam inputs are connected to the valve outputs of the valves of the existing strip blasting apparatus. The nozzle beams are arranged in the areas of the edge zones of the strip blasting apparatus. The blasting nozzles of the strip blasting apparatus are controlled in such a way that always only that nozzle is provided with compressed air which is located next to the last edge zone nozzle, i.e., is located outside of the existing blasting range, so that the strip edge is specifically blasted and dried.

3 Claims, 4 Drawing Sheets

STRIP BLASTING APPARATUS

BACKGROUND OF THE INVENTION

1. Field of the Invention

The present invention relates to an apparatus for blasting a strip emerging from a roll stand, wherein the apparatus includes a separate strip edge blasting unit.

2. Description of the Related Art

When manufacturing rolled products, particularly rolled strip, it is necessary to dry by means of compressed air the strip which emerges from a roll stand and is covered with cooling liquid. For this purpose, it is known in the art to use a strip blasting unit which, independently of the minimum and maximum strips widths, is composed of a middle zone with nozzles and several individually switchable end zones. However, this end zone strip blasting unit usually is not sufficient for blasting off the cooling liquid which is dragged through the roll gap in the area of the strip edge. For this reason, frequently a separate strip edge blasting unit is installed in which the blasting nozzle is manually or mechanically or displaceably moved into the area of the strip edge; accordingly, this unit is very complicated.

SUMMARY OF THE INVENTION

Therefore, it is the primary object of the present invention to improve strip edge blasting in strip blasting apparatus of the above-described type.

In accordance with the present invention, the strip edge blasting unit and the strip blasting apparatus are control-technically connected to each other.

The present invention is based on the concept of utilizing the already required valve control of the middle and edge zones of an existing strip blasting apparatus and automatically to blast the supplied compressed air also at the strip edge areas, without having to carry out or provide for an additional manual manipulation or a drive for adjusting to the strip width being rolled, so that strip edge blasting starts automatically when strip blasting begins.

In accordance with a further development of the invention, the strip edge blasting unit includes mainfold type nozzle beams with several nozzles whose nozzle beam inputs are connected to the valve outputs of the valves of the existing strip blasting apparatus. The nozzle beams are arranged in the areas of the edge zones of the strip blasting apparatus. The blasting nozzles of the strip blasting apparatus are controlled in such a way that always only that nozzle is provided with compressed air which is located next to the last edge zone nozzle, i.e., is located outside of the existing blasting range, so that the strip edge is specifically blasted and dried.

In accordance with another further development of the present invention, the nozzle beams include pistons arranged in series one behind the other, wherein the pistons are provided with a common actuating means. The actuating means may be a centrally arranged spring which rests against a cover of the nozzle beam and holds the pistons in their initial or non-active positions in which they are closed and prevent air from emerging. Accordingly, the pistons arranged in the nozzle beam and movable horizontally relative to each other close the nozzle outlets when they are in the pretensioned state or when they are actuated; the number of nozzles of the strip edge blasting unit depends on the number of edge zones or the nozzles provided for the edge zones. When the strip edge blasting unit is active, only that nozzle connection is supplied with compressed air which is located next to the last activated edge zone nozzle. For example, if a strip with minimum strip width is being rolled, the first nozzle of the nozzle beam located next to the rolled strip is opened. For this purpose, the supplied compressed air not only displaces the first piston but all other pistons, against the force of the activating means, i.e., the compressed air. For this purpose, the passage to the first nozzle is released through the piston ring surface and the compressed air of this nozzle is blasted against the strip edge while all other nozzles remain closed.

In accordance with a preferred embodiment of the invention, the pistons all have the same diameter and are equipped with pins having different diameters, such that the diameters increase from the one outer piston toward the other outer piston. Consequently, the individual pins define specifically stepped piston ring surfaces of different sizes. The piston of the nozzle beam which is most remote from the edge zone of the normal strip blasting apparatus has the smallest pin diameter, while the piston of the nozzle beam located closest to the edge zone has the greatest diameter. This makes it possible that, even when compressed air is supplied to all nozzle beam connections, still only one specific nozzle is released and blasts toward the strip edge; on the other hand, the other nozzle outlets which are not required remain closed. This is achieved by the fact that the sum of the annular surfaces of the pistons, starting from the piston having the greatest pin diameter, does not exceed the piston surface of the piston with the smallest pin diameter. This ensures that when, for example, the piston with the smallest pin diameter is first supplied with compressed air, only the nozzle corresponding to this piston carries out blasting and the remaining nozzles remain closed even though compressed air is supplied to their corresponding beam inlets.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
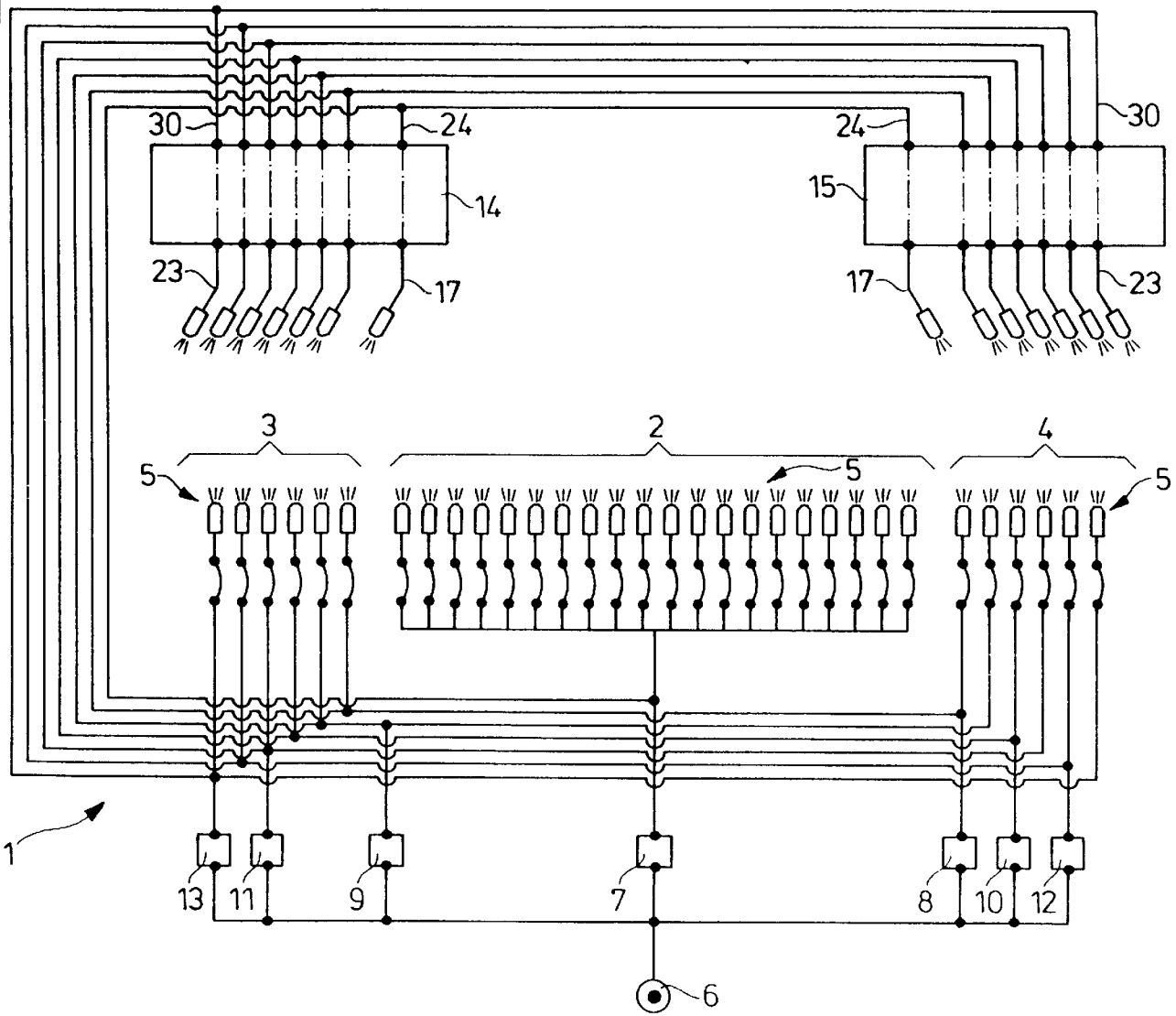
FIG. 1 is a circuit diagram of a strip blasting apparatus which is connected to the strip edge blasting unit.

FIG. 1 of the drawing is a circuit diagram of a strip blasting apparatus 1 which is arranged following a roll stand, not shown, and is used for drying the strip emerging from the stand. The strip blasting apparatus 1 includes a middle zone 2 and two edge zones 3, 4. For blasting the strip, the zones 2, 3, 4 each have several nozzles 5. The strip blasting apparatus 1 is supplied with compressed air through valves 7 to 13 from a compressed air source 6. Compressed air is supplied through the valve 7 uniformly to the nozzles 5 of the middle zone 2 and through the valves 8–13 selectively to the nozzles 5 of the edge zones 3, 4. Each output of the valves 7–13, indicated by a black dot each, is additionally connected to nozzle inputs of two nozzle beams 14, 15, only schematically illustrated as black boxes, of a strip edge blasting unit 16, wherein a nozzle beam is arranged on each strip edge side.

In the following, the manner of operation of one of the nozzle beams 14, 15 is explained in more detail with the aid of FIGS. 2*a*, 2*b* and 2*c*.

Figure 2A:
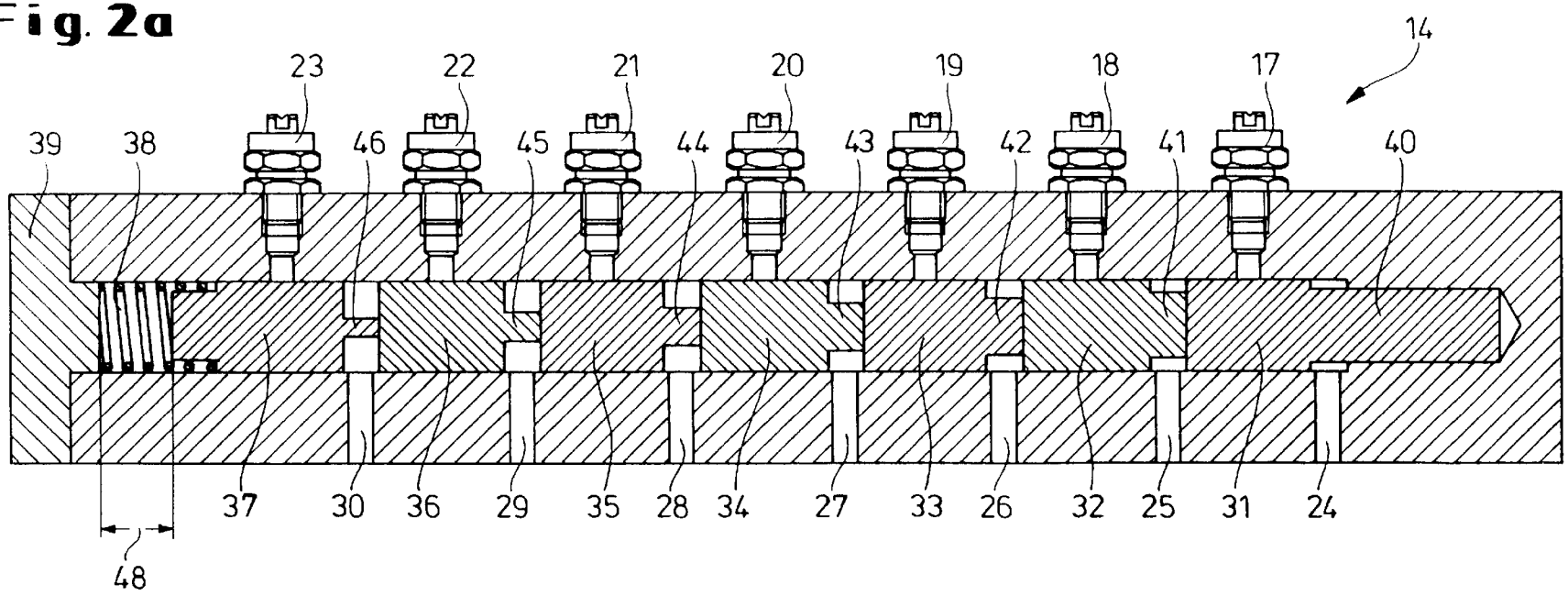
FIGS. 2*a*, 2*b* and 2*c* are longitudinal sectional views of a nozzle beam, shown in different positions of operation.

FIG. 2*a* shows the nozzle beam 14 illustrated in FIG. 1 only as a black box in more detail in a longitudinal sectional view.

The nozzle beam 14 is provided at the top thereof with seven nozzles 17–23, wherein nozzle beam inlets 24–30 are located opposite the nozzles 17–23. A plurality of pistons 31–37 located in series one behind the other are arranged in the nozzle beam 14; in the illustrated embodiment, the pistons 31–37 are pretensioned against a cover 39 by means of a compression spring 38 and, in the illustrated non-active position, close the nozzles 17–23. All pistons 31–37 have the same piston diameters, while their pins 40–46, starting from the outer piston 37 shown on the left in the drawing have increasing diameters.

Figure 2B:
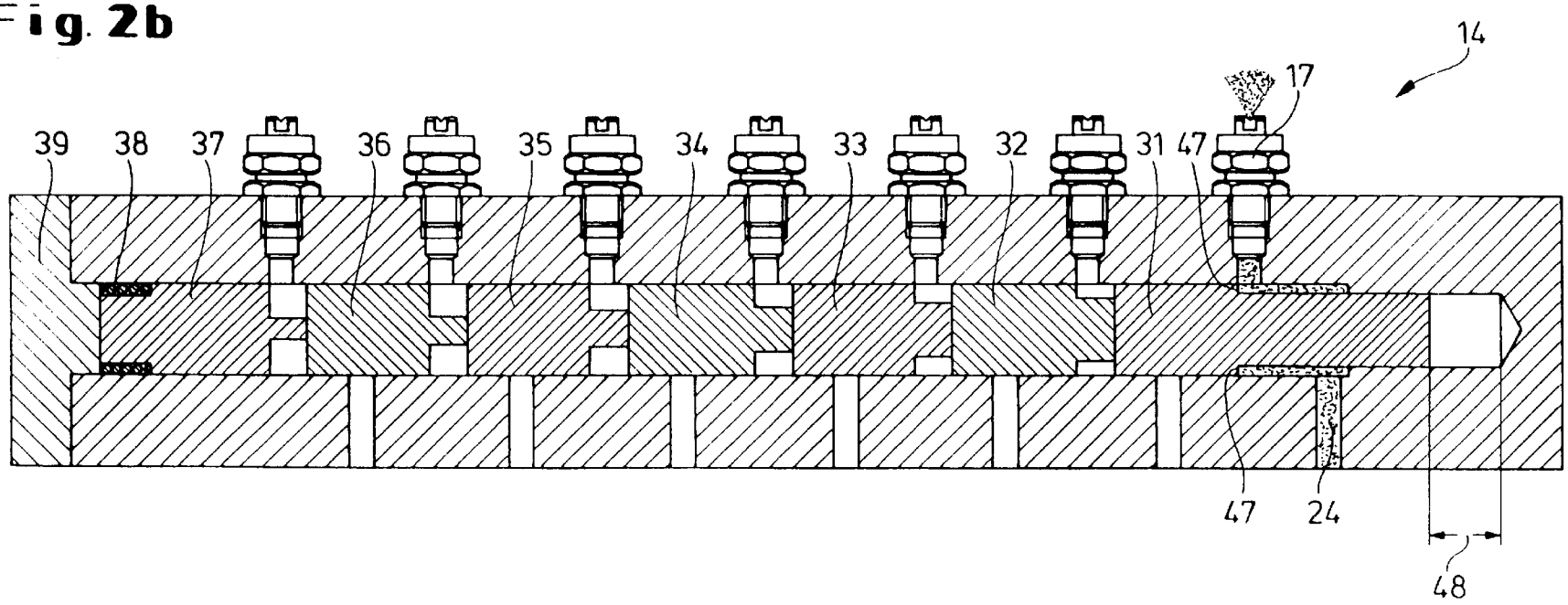

FIG. 2*b* shows the nozzle beam 14 with an active strip blasting apparatus 1 for the smallest strip width of the metal strip to be rolled. Controlled by the valve 7 shown in FIG. 1, the compressed air flows through the nozzle beam inlet 24 and presses the outermost right piston 31 over its annular surface 47 and simultaneously all other pistons 32–37 against the compression spring 38 which rests against the cover 39; for this adjusting movement, a free space 48 is available in a central bore of the nozzle beam housing which receives the pistons 32–37. The passage to the nozzle 17 is released and, thus, the compressed air can be blasted against the strip edge.

Figure 2C:
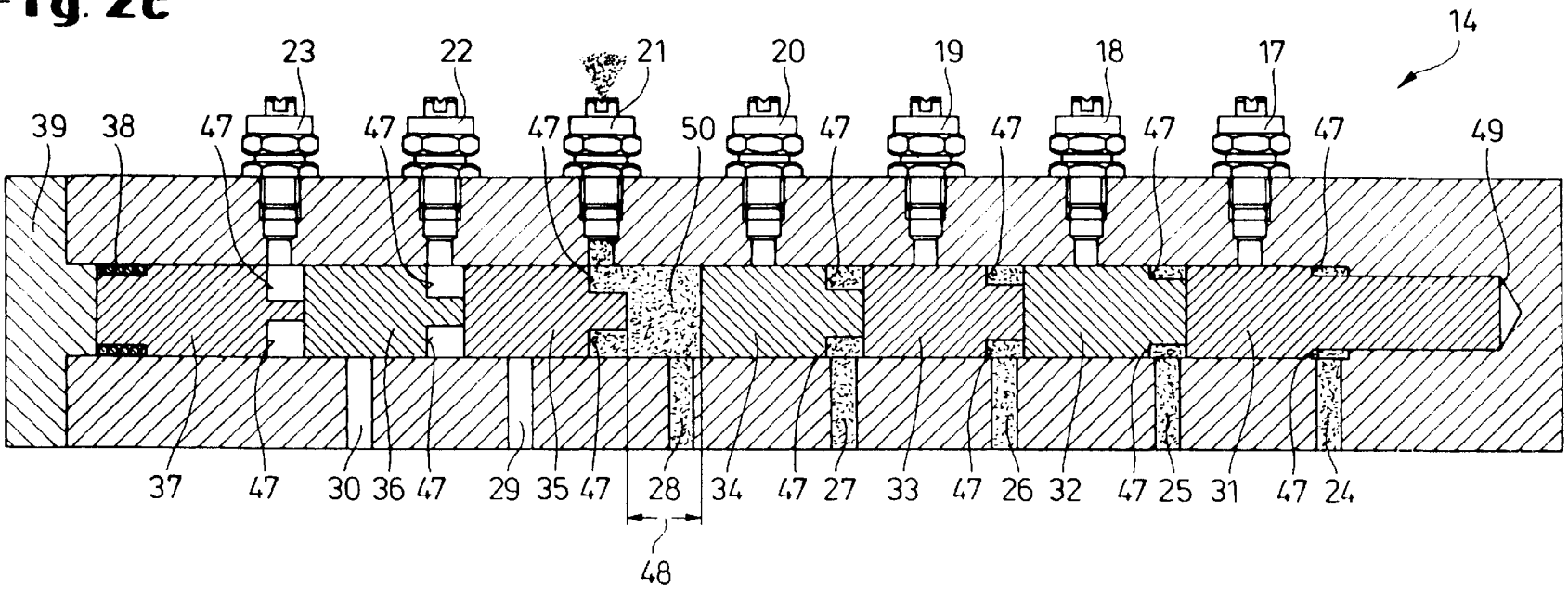

FIG. 2*c* shows the nozzle beam 14 in a position of operation in which only the nozzle 21 blasts against the strip edge, even though compressed air is also supplied to the nozzle beam inlets 24–28 of the nozzles 17–20 arranged on the right through the valves 7–11. The compressed air flows through the beam inlets 24–28 and presses the piston 35 over its annular surface 47 and the pistons 36, 37 of the nozzles 22, 23 located to the left of the nozzle 21 to be switched on against the spring 38. Since the same pressure acts on the piston ring surfaces 47 of the pistons 31–34 of the nozzles 17–20 located to the right of the nozzle 21 to be unlocked or switched on, so that these pistons also have the tendency to be moved in the direction of spring 38, the circuit ensures that the nozzle beam inlet 28 of the nozzle 21 to be activated is first supplied with compressed air. Because the diameters of the pins 40–46 are stepped, so that certain ratios of the piston ring surfaces are adjusted, the pistons 35–37 are pressed against the spring 38 and the pistons 31–34 are pressed in the opposite direction against a stop 49 provided at this location, i.e., the end of the center bore of the beam housing. The compressed air flowing through the nozzle beam inlet 28 also acts on the full piston surface 50 of the piston 34. The free cross-section of the sum of the annular surfaces 47 of the pistons 31–34 does not exceed the surface area of the piston surface 50 of the piston 34, which ensures that the nozzles 17–20 remain closed and only the valve 21 is switched to free passage, i.e., is open.

This makes it possible that always only the nozzle of the nozzle beam 14, 15 is supplied with pressure which is located next to the last nozzle of the edge zones 3, 4 to which compressed air is supplied. This ensures that the strip edge is also dried in a specific manner.

While specific embodiments of the invention have been shown and described in detail to illustrate the inventive principles, it will be understood that the invention may be embodied otherwise without departing from such principles.

I claim:

1. An apparatus for blasting a strip emerging from a roll stand, the apparatus comprising a strip blasting unit and a separate strip edge blasting unit having control valves, further comprising means for jointly controlling the strip edge blasting unit and the strip blasting unit, wherein the strip edge blasting unit comprises nozzle beams each having a plurality of nozzles, wherein the nozzle beams have nozzle beam inputs each connected to a valve output of valves of the strip blasting unit.

2. The apparatus according to claim 1, wherein the nozzle beams comprise pistons arranged in series one behind the other, a common activating means being provided for the pistons.

3. The apparatus according to claim 2, wherein the pistons each have the same diameter and are provided with pins having different diameters, wherein the diameter of one of an outer piston increases toward another of an outer piston.

* * * * *